United States Patent [19]

Mann

[11] 4,112,577

[45] Sep. 12, 1978

[54] METHOD OF MAKING ELECTRIC HEATER

[75] Inventor: Gamdur S. Mann, Flint, Mich.

[73] Assignee: General Motors Corporation, Detroit, Mich.

[21] Appl. No.: 876,692

[22] Filed: Feb. 10, 1978

[51] Int. Cl.[2] ..... H05B 3/00; F02P 19/00

[52] U.S. Cl. ..... 29/611; 29/613; 29/615; 123/145 A; 361/266

[58] Field of Search ..... 29/611, 613, 614, 615, 29/619, 610 R; 361/266; 219/260, 270, 267; 123/145 R, 145 A

[56] References Cited

U.S. PATENT DOCUMENTS

| | | | |
|---|---|---|---|
| 2,506,768 | 5/1950 | Bentz et al. | 123/145 A X |
| 2,672,546 | 3/1954 | Klingner et al. | 123/145 A X |
| 2,898,571 | 8/1959 | Moule et al. | 123/145 A |
| 3,158,787 | 11/1964 | Testerini | 361/266 X |
| 3,234,633 | 2/1966 | Baxter | 29/614 |
| 3,749,980 | 7/1973 | Baxter | 361/266 X |

*Primary Examiner*—Victor A. DiPalma
*Attorney, Agent, or Firm*—Robert J. Outland

[57] ABSTRACT

A sheathed electric heater for use as an engine glow plug or the like is formed by providing a closed end metal sheath with a diameter larger than the finished diameter, Installing in the sheath a centered electric heating element having an enlarged diameter portion that engages the sheath adjacent to its closed end, the sheath and heating element being formed of compatible metals capable of being welded together by cold working, filling the sheath interior around the element with granular electrical insulating material, and swaging the assembly to reduce its diameter, extend its length, compact the insulation and cold work the engaged end portions of the sheath and heating coil so as to increase their engagement pressure and thereby establish a low resistance electrical connection between them.

2 Claims, 5 Drawing Figures

METHOD OF MAKING ELECTRIC HEATER

BACKGROUND OF THE INVENTION

This invention relates to electric heaters and their manufacture and more particularly to tubular heaters of a type usable as engine glow plugs or for other localized heating applications and having a conductive tubular sheath surrounding an electrical heating coil.

It is known in the electric heater art to provide heaters for use as engine glow plugs and the like which have a closed end tubular protective metal sheath surrounding an axially extending heating element. The element is electrically connected with the closed end of the sheath and also connects with an electrode extending from the sheath open end. The remainder of the sheath interior is packed with a suitable electrical insulating material such as magnesium oxide (MgO).

A prior method of manufacturing such heaters has included a step of hot welding the end of the coiled heating element to the closed end of the sheath in order to provide a satisfactory electrical connection between the heating element and the sheath. Even though this welding is carefully done, localized metallurgical changes may result in resistance variations and susceptability to cracking during a subsequent swaging operation. This may affect the usability of the resulting part. Another problem of such heaters in service is caused by internal oxidation of heating element, possibly due to oxygen generated from the moisture content of the magnesium oxide or from other external sources. Such oxidation may result in excessive localized heating and the eventual breakdown of the heating element.

SUMMARY OF THE INVENTION

The present invention provides an improved heating construction and method of manufacture which reduces the above mentioned problems. This is accomplished in part by eliminating the hot welding step and providing the required low resistance electrical connection by mechanical swaging of the sheath to a smaller diameter while the coil end turns are in engagement with the sheath. This action compresses both the sheath and the heating coil and causes cold working of their engaged portions under pressure. When the sheath and heating coil are formed of compatable materials capable of being welded together by cold working, the swaging action causes the engaged portions of the sheath and heating coil to establish a low resistance electrical connection between them.

These and other features of the invention will be more fully understood from the following description of a preferred embodiment and method of manufacture taken together with the accompanying drawing.

BRIEF DESCRIPTION OF THE ILLUSTRATED EMBODIMENT

Figure 1:
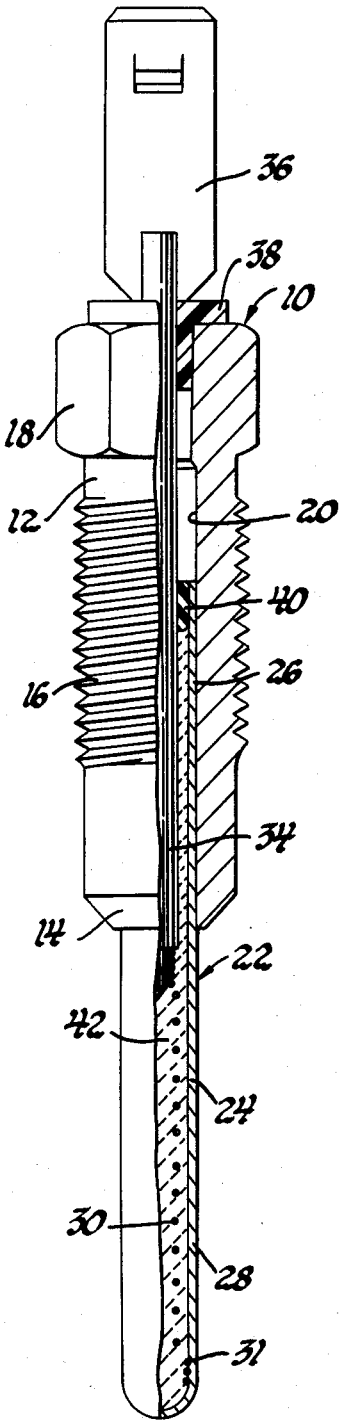
FIG. 1 is a side elevational view of a diesel engine glow plug formed according to the invention and having portions broken away to show the interior construction.

In the drawing, numeral 10 generally indicates a diesel engine glow plug having the features of and made in accordance with the method of this invention.

Glow plug 10 includes a conventional metal outer shell 12 having a conical sealing surface 14 at one end, a threaded portion 16 intermediate the ends and a hexagonal head 18 at the end opposite the sealing surface. The shell includes a longitudinal bore 20 in the lower portion of which there is press-fitted a sheathed heater assembly generally indicated by numeral 22.

Heater assembly 22 includes a tubular metal sheath 24 having an upper open end portion 26 fixed within the bore 20 and an elongated closed end portion 28 extending outwardly of the shell along the axis of the bore 20.

Centered within the sheath is a longitudinally extending electrical resistance heating coil or element 30, one end 31 of which comprises an enlarged portion that engages the sheath near its closed end. At this end, the sheath and heating coil are mechanically and electrically joined in a low resistance connection through cold working under pressure in a swaging step to be subsequently described.

The heating coil extends from the closed end of the tubular sheath up to about its center, at which point it is attached, preferably by flash welding, to the end of a center rod or terminal 34. The terminal extends out through the open end of the sheath 24 and through the bore 20 to extend outwardly of the hex headed end of the shell 12. A terminal blade 36 is affixed to the exposed end of the center terminal to receive an electrical attaching clip. The terminal 34 is centered within and insulated from the shell 12 and sheath 24 by a phenolic insulator 38 between the terminal and shell and a compressed rubber o-ring 40 between the terminal and the open end of the sheath. The remaining space within the sheath is filled with a suitable electrical insulating material 42 such as compressed granulated magnesium oxide which holds the heating coil and terminal in their centered positions within the sheath and prevents electrical contact between them, except at the intentionally joined points adjacent the closed end of the sheath.

The construction is such that upon installation of the glow plug in an engine with appropriate electrical connections, a current may be passed from the blade 36 through the terminal and heating coil to the closed end of the sheath, and therethrough back to the shell which is grounded to the engine, causing the heating coil to raise to operating temperature the exposed end of the sheathed heater assembly.

A preferred method of making an electric heater of the type used in the glow plug illustrated in FIG. 1 is as follows.

First, the closed end tubular sheath 24 is formed with a diameter about 30 percent larger and a length about 30 percent shorter than desired finished dimensions. The wire heating coil 30 is then wound in a helix smaller than the interior diameter of the sheath, except at the enlarged end portion 31 which is tightly wound with another diameter about equal to the sheath inner diameter. The smaller end of the coil 30 is then attached by flash welding to one end of the center terminal 34 to form a terminal and coil assembly. This assembly is then inserted into the open end of the sheath 24 and centered therein with the enlarged diameter lower end 31 of the heating coil engaging the inner surface adjacent the closed end of the sheath. The contacting surfaces of both the coil and the sheath should be free of foreign substances at this time.

Figure 2:
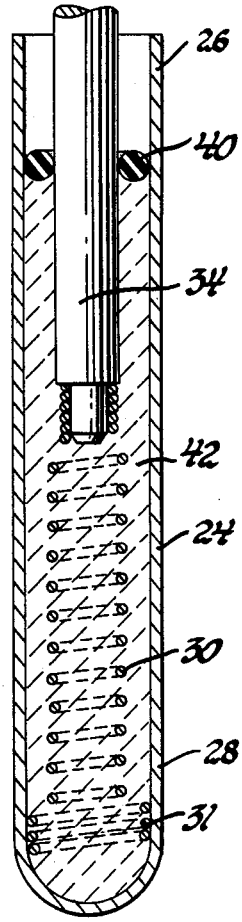
FIG. 2 is a longitudinal cross-sectional view of a heater assembly before swaging.

Subsequently, the open areas within the tube at the locations of the heating coil and part way up the center terminal are filled with the insulating material 42, which is preferably granulated magnesium oxide. The loose material is compacted and is retained in place by the placement of the o-ring 40 in the annular space between the terminal 34 and sheath 24, spaced slightly inward from the open upper end of the sheath, as shown in FIG. 2.

Figure 3:
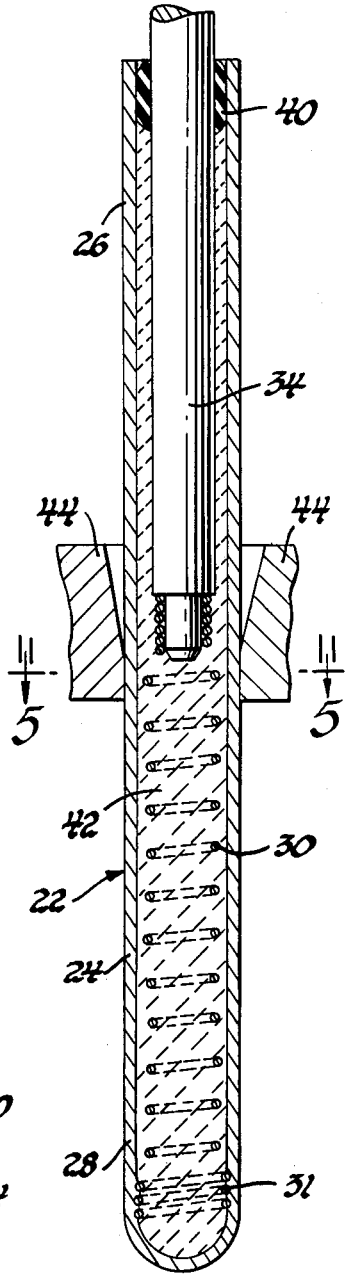
FIG. 3 is a longitudinal cross-sectional view showing the heater assembly in the swaging dies at the conclusion of the swaging step.
Figure 4:
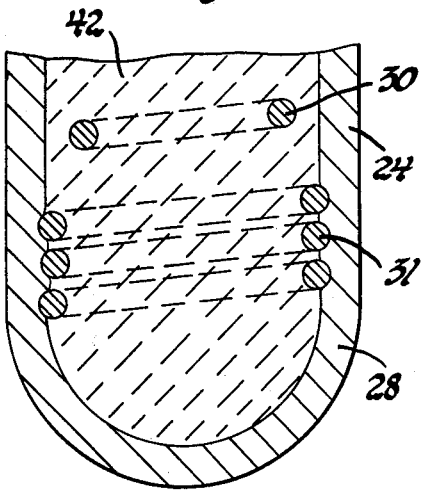
FIG. 4 is an enlarged view of a portion of FIG. 3 showing the engaged portions of the sheath and heating coil after swaging.
Figure 5:
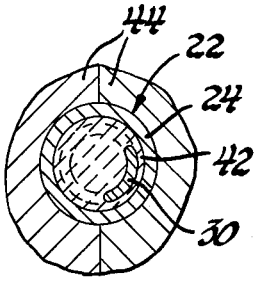
FIG. 5 is a transverse cross-sectional view taken in the plane indicated by the line 5—5 of FIG. 3 and further illustrating the swaging dies and heater assembly.

Thereafter, the assembly is swaged to reduce its diameter and extend its length. Preferably, the swaging operation is done in multiple steps, with the open end of the sheath being swaged first in order to compress the o-ring 40 and positively prevent the escape of any of the insulating material 42. The assembly is then swaged from its closed end until the whole length of the assembly has been reduced and extended to the final dimensions of the heater assembly 22. FIGS. 3–5 illustrate the assembly after swaging while still within the swaging dies 44.

The swaging operation deforms the outer sheath in a cold working process while compressing and extending the heating coil and surrounding insulation within the sheath. The tightly wound end portion 31 of the heating coil, which is in engagement with the sheath interior, is squeezed to a smaller diameter by the reduction in sheath diameter. This action causes the sheath material to flow partially around the coil wires as is best shown in FIG. 4. At the same time, an intimate joining of the surfaces takes place, forming a low resistance electrical connection between the sheath and heating coil. This is believed to occur in the manner of cold welding of components under pressure.

To best accomplish the desired electrical connection, the materials of the sheath and heating coil should be made from compatable materials capable of being cold welded. Many such materials are capable of being so used. For example, high temperature alloys of about 80 percent nickel and 20 percent chromium are suitable for both the sheath and the heating coil. Such alloys are sold under trade names Chromel AA and Chromel A. Other nickel based alloys may also be used, such as Nichrome V for the heating coil and Inconel 601 for the sheath.

To form a glow plug as shown in FIG. 1, the sheathed heater assembly 22 is pressed into the shell 12 and the phenolic insulator 38 and terminal blade 36 are attached.

If desired, however, the sheathed heater assembly may be used in other than glow plug applications. One such application presently contemplated for such heaters is to provide heat to exhaust gas sensor devices used in engine exhaust systems and connected with electronic air-fuel ratio controls.

Glow plugs and other sheathed heater devices made in accordance with the invention as described have the advantage that high temperature welding of the heater coil to the sheath is eliminated, thus avoiding undesirable metallurgical changes at the tip of the sheath and heating coil.

While the invention has been described by reference to a specific embodiment chosen for purposes of illustration, it should be understood that numerous changes could be made in the structure and method of assembly described without departing from the inventive concepts embodied in the foregoing disclosure. Accordingly, it is intended that the invention not be limited to the specific embodiment and method disclosed, but have the full scope permitted by the language of the following claims.

I claim:

1. The method of making an electric heater of the type having an elongated electrically conductive tubular metal sheath closed at one end and containing an axially extending heating coil electrically grounded at one end to the sheath adjacent its closed end and insulated therefrom elsewhere by heat conductive insulation, said method comprising the steps of:

(a) forming the sheath with a width substantially larger than the desired finished size thereof, (b) forming the heating coil in a width dimension smaller than the interior width of the sheath except at one end where a tightly wound portion is formed with an enlarged outer width dimension about equal to the sheath inner width dimension, the coil other end being attached to an electrical conductor, (c) placing the heating coil and conductor in the sheath with the enlarged portion engaging the sheath adjacent to its closed end, the engaging surfaces of the sheath interior and the coil enlarged portion being free from foreign substances, and centering the remainder of the coil within the sheath with the attached conductor extending from the open end, (d) filling the open interior of the sheath with granular high temperature electrical insulating material tightly packed around and within the heating coil and sealing the open end of the sheath to retain the insulating material in place, and (e) swaging the heater assembly to reduce the width and extend the length of the sheath and interior heating coil to finished dimensions said sheath and said heating coil being formed of compatable metals whereby said swaging step causes the engaging portions of the sheath and heating coil to establish a low resistance electrical connection therebetween.

2. The method of making an electric heater of the type having an elongated electrically conductive tubular metal sheath closed at one end and containing an axially extending heating coil electrically grounded at one end to the sheath adjacent its closed end and insulated therefrom elsewhere by heat conductive insulation, said method comprising the steps of:

(a) forming the sheath with a diameter substantially larger than the desired finished size thereof, (b) winding the heating coil in a helix smaller than the interior diameter of the sheath except at one end where a tightly wound portion is formed with an enlarged outer diameter about equal to the sheath inner diameter, the coil other end being attached to an electrical conductor, (c) placing the heating coil and conductor in the sheath with the enlarged diameter portion engaging the sheath adjacent to its closed end, the engaging surfaces of the sheath interior and the coil enlarged diameter portion being free from foreign substances, and centering the remainder of the coil within the sheath with the attached conductor extending from the open end, (d) filling the open interior of the sheath with granular high temperature electrical insulating material tightly packed around and within the heating coil and sealing the open end of the sheath to retain the insulating material in place, and (e) swaging the heater assembly to reduce the diameter and extend the length of the sheath and interior heating coil to finished dimensions, said sheath and said heating coil being formed of compatable metals capable of being welded together by cold working under pressure, whereby said swaging step causes the engaging portions of the sheath and heating coil to establish a low resistance electrical connection therebetween.

* * * * *